US011168697B2

(12) United States Patent
Mitsuhashi et al.

(10) Patent No.: US 11,168,697 B2
(45) Date of Patent: Nov. 9, 2021

(54) VACUUM PUMP, ROTATING PORTION INCLUDED IN VACUUM PUMP, AND IMBALANCE CORRECTION METHOD

(71) Applicant: Edwards Japan Limited, Chiba (JP)

(72) Inventors: Keita Mitsuhashi, Chiba (JP); Toshiyuki Ooki, Chiba (JP)

(73) Assignee: EDWARDS JAPAN LIMITED, Chiba (JP)

( * ) Notice: Subject to any disclaimer, the term of this patent is extended or adjusted under 35 U.S.C. 154(b) by 6 days.

(21) Appl. No.: 16/482,903

(22) PCT Filed: Feb. 2, 2018

(86) PCT No.: PCT/JP2018/003627
§ 371 (c)(1),
(2) Date: Aug. 1, 2019

(87) PCT Pub. No.: WO2018/147191
PCT Pub. Date: Aug. 16, 2018

(65) Prior Publication Data

US 2020/0011336 A1 Jan. 9, 2020

(30) Foreign Application Priority Data

Feb. 8, 2017 (JP) ..... JP2017-021322

(51) Int. Cl.
*F04D 19/04* (2006.01)
*F04D 29/66* (2006.01)
*F04D 29/058* (2006.01)

(52) U.S. Cl.
CPC ..... *F04D 19/042* (2013.01); *F04D 19/048* (2013.01); *F04D 29/058* (2013.01); *F04D 29/662* (2013.01); *F05D 2260/15* (2013.01)

(58) Field of Classification Search
CPC ..... F04D 19/04; F04D 19/042; F04D 29/023; F04D 29/522; F04D 17/168; F04D 29/662
(Continued)

(56) References Cited

U.S. PATENT DOCUMENTS 5,695,316 A * 12/1997 Schutz ..... F04D 17/168 415/143
6,638,010 B2 * 10/2003 Conrad ..... F04D 17/168 415/143
(Continued)

FOREIGN PATENT DOCUMENTS

EP 2913533 A1 9/2015
JP S61114089 U 7/1986
(Continued)

OTHER PUBLICATIONS

PCT International Search Report dated Apr. 24, 2018 for corresponding PCT Application No. PCT/JP2018/003627.
(Continued)

*Primary Examiner* — Patrick Hamo
(74) *Attorney, Agent, or Firm* — Theodore M. Magee; Westman, Champlin & "Koehler, P.A.

(57) ABSTRACT

In a vacuum pump, a portion of a lower end portion of a rotating cylindrical body is cut in an axial direction thereof to form an imbalance correction portion (removal portion). Preferably, the removal portion is formed so as to minimize an axial width of the rotating cylindrical body and set a circumferential width of the rotating cylindrical body to a value of not less than a thickness (width in a radial direction) of the rotating cylindrical body. Additionally, a corner formed in the removal portion is formed to have a large. With this configuration, in the rotating cylindrical body, the removal portion is formed to have a shape in which a removal width (depth) in the axial direction of the rotating
(Continued)

cylindrical body is small and a removal width in the circumferential direction thereof is large.

11 Claims, 7 Drawing Sheets

(58) Field of Classification Search
USPC ..... 417/423.4
See application file for complete search history.

(56) References Cited

U.S. PATENT DOCUMENTS

| | | | | |
|---|---|---|---|---|
| 7,850,434 | B2 * | 12/2010 | Stones | F04D 19/04 417/250 |
| 2003/0108440 | A1 * | 6/2003 | Englnder | F04D 19/042 417/368 |
| 2008/0138219 | A1 * | 6/2008 | Stones | H01J 49/24 417/423.4 |
| 2013/0224001 | A1 | 8/2013 | Shirinov et al. | |
| 2016/0265359 | A1 | 9/2016 | Annati et al. | |

FOREIGN PATENT DOCUMENTS

| | | | |
|---|---|---|---|
| JP | H0174398 | | 5/1989 |
| JP | H02305393 | A | 12/1990 |
| JP | 2002327697 | A | 11/2002 |
| JP | 2003021092 | A | 1/2003 |
| JP | 2003148378 | A | 5/2003 |
| JP | 2006022771 | A | 1/2006 |
| JP | 3819267 | B2 | 9/2006 |
| JP | 3974772 | B2 | 9/2007 |
| JP | 2008178233 | A | 7/2008 |
| JP | 2010206884 | A | 9/2010 |
| JP | 2013217226 | | 10/2013 |
| JP | 2016166594 | A | 9/2016 |

OTHER PUBLICATIONS

PCT International Written Opinion dated Apr. 24, 2018 for corresponding PCT Application No. PCT/JP2018/003627.
European Communication dated Oct. 20, 2020 for corresponding European Application No. 18751514.3, 10 pages.

* cited by examiner

VACUUM PUMP, ROTATING PORTION INCLUDED IN VACUUM PUMP, AND IMBALANCE CORRECTION METHOD

CROSS-REFERENCE OF RELATED APPLICATION

This application is a Section 371 National Stage Application of International Application No. PCT/JP2018/003627, filed Feb. 2, 2018, which is incorporated by reference in its entirety and published as WO 2018/147191 A1 on Aug. 16, 2018 and which claims priority of Japanese Application No. 2017-021322, filed Feb. 8, 2017.

BACKGROUND

The present invention relates to a vacuum pump, a rotating portion included in the vacuum pump, and an imbalance correction method. More particularly, the present invention relates to a structure which corrects the balance of the rotating portion included in the vacuum pump.

Conventionally, a vacuum pump such as a turbo molecular pump is widely prevalent. In such a vacuum pump, a rotor portion (including a shaft and a rotor) and a rotating portion including a rotor blade and a rotating cylindrical body are each rotated at a high speed in a casing having an inlet port and an outlet port to perform an exhaust process. In the vacuum pump, when the rotor portion and the rotating portion are rotated at a high speed using a magnetic bearing or the like, minor imbalance inherent in each of the components of the vacuum pump or minor imbalance caused depending on the assembled state of the components causes vibration or noise. The minor imbalance may also interrupt the intrinsic operation of the vacuum pump.

To correct such imbalance, balancing/imbalance correction is performed on the rotating portion of the vacuum pump during high-speed rotation.

As a method for such imbalance correction, imbalance correction based on mass addition which adds a mass to the rotating portion, imbalance correction based on mass removal which removes a mass from the rotating portion, and the like are known.

FIG. 6 and FIG. 7 are views for illustrating a related-art technique.

FIG. 6 is a view for illustrating the related-art imbalance correction based on the mass addition.

FIG. 7 is a view for illustrating the related-art imbalance correction based on the mass removal.

In the related-art imbalance correction based on the mass addition, as shown in FIG. 6, a mass adding means which adds a mass is used, such as an epoxy resin 1100 disposed in a groove provided in an inner peripheral surface of a rotating cylindrical body 1000 or a bolt (or a screw or a metallic washer) 1200 provided in a rotor portion.

Meanwhile, in the related-art imbalance correction based on the mass removal, as shown in FIG. 7, a side surface (i.e., a cylindrical body outer peripheral surface 2001 as an outer peripheral surface or a cylindrical body inner peripheral surface 2002 as an inner peripheral surface) of a rotating cylindrical body 2000 is partly removed (cut) to effect imbalance correction.

In another method, a shaft lower portion 71 or a shaft lower end portion 72 (armature disc) of a shaft 70 is partly removed using a drill or a router to effect imbalance correction.

The discussion above is merely provided for general background information and is not intended to be used as an aid in determining the scope of the claimed subject matter. The claimed subject matter is not limited to implementations that solve any or all disadvantages noted in the background.

SUMMARY

In recent years, particularly when a vacuum pump is used in a process in which a corrosive gas is allowed to flow, anti-corrosion coating is performed on a rotating portion of the vacuum pump, and then a mass adding means made of a resin-based material having an anti-corrosive property (i.e., the epoxy resin 1100) is added thereto to effect imbalance correction.

However, in a configuration for the relative-art imbalance correction based on the mass addition described above, during the operation of the vacuum pump, the mass adding means (such as the epoxy resin 1100 or the bolt 1200) may fall off.

In addition, irrespective of whether or not the corrosive gas is allowed to flow in the process, due to ozone or a gas in a plasma state used during the process or cleaning, the mass adding means (the epoxy resin 1100) may disappear.

Meanwhile, in a configuration for the related-art imbalance correction based on the mass removal described above, a problem arises in that, when the rotating portion is cut (removed) using a tool having a sharply pointed tip, such as a drill, as a cutting tool, a stress is likely to be concentrated on a portion resulting from the removal.

It is therefore an object of the present invention is to provide a vacuum pump having a structure which reduces stress concentration in imbalance correction based on mass removal, a rotating portion included in the vacuum pump, and an imbalance correction method.

The invention as in claim 1 provides a vacuum pump including a rotating portion that is enclosed in a housing having an inlet port and an outlet port each formed therein and is rotatably supported, the vacuum pump rotating the rotating portion at a high speed to transfer gas sucked in from the inlet port to the outlet port, wherein in at least a portion of a cylindrical body end portion as an end portion of the rotating portion in an axial direction thereof, an imbalance correction portion which corrects imbalance of the rotating portion is formed.

The invention as in claim 2 provides the vacuum pump according to claim 1, wherein the imbalance correction portion is in a shape of a groove having a depth in the axial direction.

The invention as in claim 3 provides the vacuum pump according to claim 1 or 2, wherein the imbalance correction portion is formed in the cylindrical body end portion of the rotating portion closer to an opening thereof.

The invention as in claim 4 provides the vacuum pump according to claim 3, wherein the imbalance correction portion has a width in a circumferential direction thereof which has a dimension of not less than a thickness of the cylindrical body end portion in a radial direction thereof.

The invention as in claim 5 provides the vacuum pump according to claim 3, wherein the imbalance correction portion has a dimension in a radial direction thereof which is not less than a thickness of the cylindrical body end portion in the radial direction.

The invention as in claim 6 provides the vacuum pump according to any one of claims 1 to 5, wherein the imbalance correction portion has a corner portion which is formed at a bottom surface of the imbalance correction portion in the axial direction or formed in the radial direction of the imbalance correction portion so as to have a dimension of not less than R3=3 mm.

The invention as in claim 7 provides the vacuum pump according to any one of claims 1 to 6, further including: a rotor blade disposed on an outer peripheral surface of at least a portion of the rotating portion so as to radially extend from the outer peripheral surface; a stator blade opposed to the rotor blade via a gap in the axial direction; and a turbo molecular pump which transfers the gas sucked in from the inlet port to the outlet port using an interaction between the rotor blade and the stator blade.

The invention as in claim 8 provides the vacuum pump according to any one of claims 1 to 6, further including: a stationary cylindrical portion disposed coaxially to the rotating portion to be opposed to the rotating portion via a gap in the radial direction, wherein, in at least a portion of at least one of respective surfaces, the surface being opposed to each other in the radial direction, of the rotating portion and the stationary cylindrical portion, a spiral groove having a valley portion and a ridge portion is disposed, the vacuum pump further including: a Holweck thread groove pump portion which transfers the gas sucked in from the inlet port to the outlet port using an interaction between the rotating portion and the stationary cylindrical portion.

The invention as in claim 9 provides the vacuum pump according to any one of claims 1 to 6, further including: a rotating disc-shaped portion disposed to radially extend from an outer peripheral surface of at least a portion of the rotating portion; and a stationary disc-shaped portion disposed coaxially to the rotating disc-shaped portion to be opposed to the rotating disc-shaped portion via a gap in the axial direction, wherein, in at least a portion of at least one of respective surfaces of the rotating disc-shaped portion and the stationary disc-shaped portion which are opposed to each other in the axial direction, a spiral groove having a valley portion and a ridge portion is disposed, the vacuum pump further including: a Siegbahn thread groove pump portion which transfers the gas sucked in from the inlet port to the outlet port using an interaction between the rotating disc-shaped portion and the stationary disc-shaped portion.

The invention as in claim 10 provides a rotating portion included in the vacuum pump in at least any one of the first to ninth aspects.

The invention as in claim 11 provides an imbalance correction method including: forming, in the vacuum pump according to any one of claims 1 to 9, the imbalance correction portion in at least a portion of the cylindrical body end portion as the end portion of the rotating portion in the axial direction in order to correct the imbalance of the rotating portion.

According to the present invention, a portion of the axial end portion (preferably, lower end portion closer to the outlet port) of a rotating cylindrical body in the vacuum pump is cut so as to reduce the thickness of the rotating cylindrical portion in the axial direction. Thus, it is possible to reduce stress concentration after imbalance correction.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

In the present embodiment, at least a portion of an axial lower end portion (closer to an outlet port) of a rotating cylindrical body is cut in an axial direction thereof to form an imbalance correction portion in the rotating cylindrical body. The imbalance correction portion is hereinafter referred to as a removal portion in the description given below.

Preferably, the removal portion is formed by cutting the lower end portion of the rotating cylindrical body so as to minimize an axial width of the rotating cylindrical body and set a circumferential width of the rotating cylindrical body to a value of not less than that of a thickness (width in a radial direction) of the rotating cylindrical body.

In addition, each of corners formed in the removal portion is formed to have a large dimension (e.g., not less than R3=3 mm) where R represents a radius of the rounded corner.

With this configuration, in the present embodiment, the rotating cylindrical body has the removal portion formed to have a shape in which a removal width (depth) of the rotating cylindrical body in the axial direction is small and a removal width in a circumferential direction thereof is large. This can reduce/lessen stress concentration after imbalance correction in the vacuum pump.

Referring to FIGS. 1 to 5, the following will describe the preferred embodiment of the present invention in detail.

Configuration of Vacuum Pump 1

Figure 1:
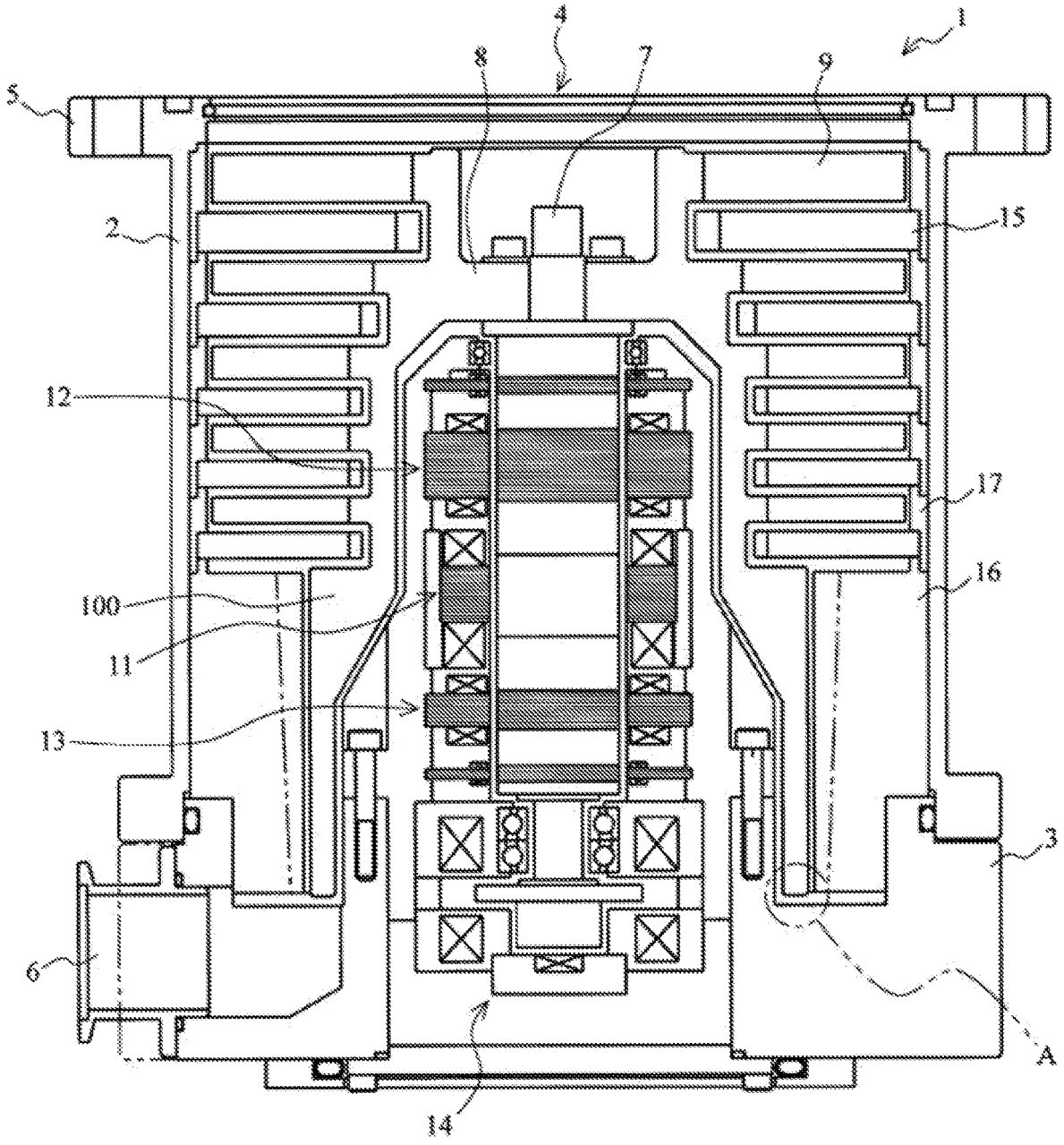
FIG. 1 is a view showing an example of a schematic configuration of a vacuum pump according to an embodiment of the present invention.

FIG. 1 is a view showing an example of a schematic configuration of a vacuum pump 1 according to the embodiment of the present invention, which shows a cross section of the vacuum pump 1 in an axial direction thereof.

A description will be given first of the vacuum pump 1 according to the present embodiment.

The vacuum pump 1 of the present embodiment is a so-called composite-type molecular pump including a turbo molecular pump portion and a thread groove pump portion.

A casing 2 forming a housing of the vacuum pump 1 has a generally cylindrical shape to form, together with a base 3 provided under the casing 2 (closer to an outlet port 6), the housing of the vacuum pump 1. In the housing of the vacuum pump 1, a gas transfer mechanism as a structure which causes the vacuum pump 1 to perform an exhausting function is contained.

The gas transfer mechanism basically includes a rotating portion which is rotatably supported and a stationary portion which is fixed with respect to the housing of the vacuum pump 1.

In an end portion of the casing 2, an inlet port 4 for introducing a gas into the vacuum pump 1 is formed. Around an end surface of the casing 2 closer to the inlet port 4, a radially outwardly protruding flange portion 5 is formed.

In the base 3, the outlet port 6 for exhausting the gas from the vacuum pump 1 is formed.

Also, in the base 3, a cooling pipe (water cooling pipe) made of a tubular (tube-shaped) member is embedded to reduce the influence of heat received by a control device from the vacuum pump 1. Thus, the temperature of the base 3 is controlled. The cooling pipe is a member for cooling the vicinity of the cooling pipe by causing a coolant as a heat medium to flow therein and absorb heat.

By thus causing the coolant to flow in the cooling pipe, the base 3 is forcibly cooled, and accordingly the heat conducted from the vacuum pump 1 to the control device is reduced.

Note that, as a material of the cooling pipe, a member having a low heat resistance, i.e., having a high heat conductivity such as, e.g., copper or stainless steel is used. The coolant caused to flow in the cooling pipe. i.e., a material for cooling an object may be either a liquid or a gas. As the liquid coolant, e.g., water, an aqueous calcium chloride solution, an aqueous ethylene glycol solution, or the like can be used. Meanwhile, as the gaseous coolant, e.g., ammonium, methane, ethane, halogen, helium, carbon dioxide, air, or the like can be used.

The rotating portion includes a shaft 7 as a rotating shaft, a rotor 8 disposed around the shaft 7, rotor blades 9 (closer to the inlet port 4) provided on the rotor 8, a rotating cylindrical body 100 (closer to the outlet port 6), and the like. Note that the shaft 7 and the rotor 8 are included in a rotor portion.

Each of the rotor blades 9 is made of a blade radially extending from the shaft 7, while being inclined at a predetermined angle from a plane perpendicular to an axis line of the shaft 7.

The rotating cylindrical body 100 is made of a cylindrical member located under the rotor blades 9 and having a cylindrical shape coaxial to a rotation axis of the rotor 8.

In the present embodiment, in at least a portion of a lower end portion (A) of the rotating cylindrical body 100 shown by the two-dot-dash line in FIG. 1, the removal portion described later is formed.

Around a middle of the shaft 7 in the axial direction, a motor portion 11 for rotating the shaft 7 at a high speed is provided.

In addition, on the inlet port 4 side of the motor portion 11 of the shaft 7 and on the outlet port 6 side thereof, radial magnetic bearing devices 12 and 13 for supporting the shaft 7 in non-contact relation in the radial direction (diametrical direction) are provided while, at the lower end of the shaft 7, an axial magnetic bearing device 14 for supporting the shaft 7 in non-contact relation in the axis direction (axial direction) is provided.

On the inner peripheral side of the housing (casing 2) of the vacuum pump 1, the stationary portion (stationary cylindrical portion) is formed. The stationary portion includes stator blades 15 provided closer to the inlet port 4 (turbo molecular pump portion), a thread groove spacer 16 (thread groove pump portion) provided on an inner peripheral surface of the casing 2, and the like.

Each of the stator blades 15 is formed of a blade extending from the inner peripheral surface of the housing of the vacuum pump 1 toward the shaft 7, while being inclined at a predetermined angle from a plane perpendicular to the axis line of the shaft 7.

The stator blades 15 at individual levels are separated from each other by spacers 17 each having a cylindrical shape.

In the vacuum pump 1, the stator blades 15 are formed at the plurality of levels to alternate with the rotor blades 9 in the axial direction.

The thread groove spacer 16 has a helical groove formed in a surface thereof opposed to the rotating cylindrical body 100. The thread groove spacer 16 is configured to be opposed to an outer peripheral surface of the rotating cylindrical body 100 via a predetermined clearance (space). A direction of the helical groove formed in the thread-groove spacer 16 corresponds to a direction in which a gas flows toward the outlet port 6 when transported in a direction of rotation of the rotor 8 in the thread groove. Note that the helical groove may be provided appropriately in at least one of the respective opposed surfaces of the rotating portion and the stationary portion.

The helical groove has a depth gradually decreasing with approach to the outlet port 6, and is therefore configured such that the gas transported in the helical groove is increasingly compressed with approach to the outlet port 6.

The vacuum pump 1 thus configured performs a vacuum exhaust process in a vacuum chamber (not shown) disposed in the vacuum pump 1. For example, the vacuum chamber is a vacuum device used as a chamber or the like in a surface analysis device or a microfabrication device.

Configuration of Rotating Cylindrical Body

Next, a description will be given of a configuration of the rotating cylindrical body 100 disposed in the vacuum pump 1 having a configuration as described above.

Figure 2:
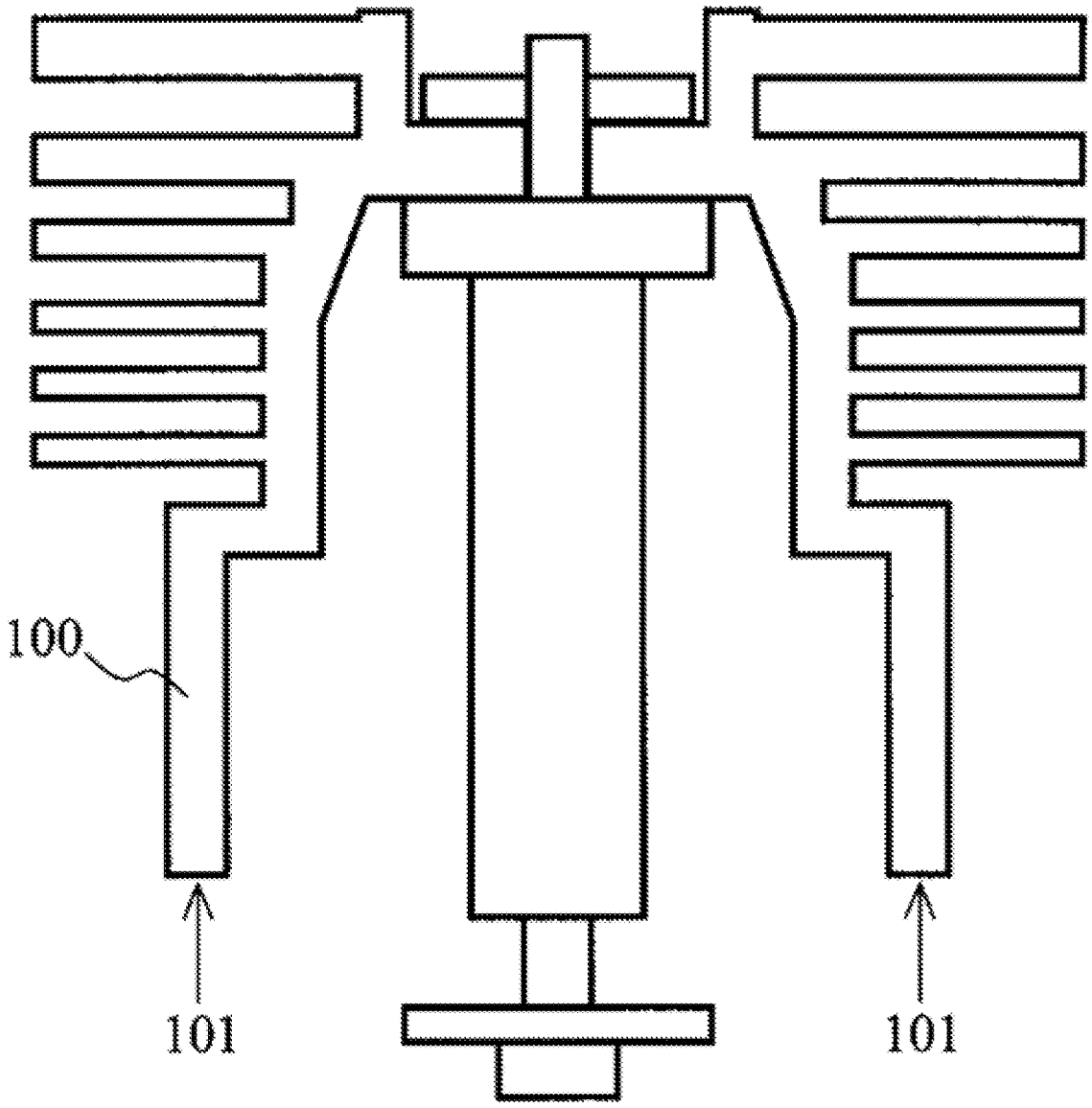
FIG. 2 is a view for illustrating a rotating cylindrical body according to the embodiment of the present invention.

FIG. 2 is a view for illustrating the rotating cylindrical body 100 according to the embodiment of the present invention.

The rotating cylindrical body 100 of the present embodiment has the removal portion in at least a portion of a cylindrical body lower end portion 101 as a lower surface of the rotating cylindrical body 100 closer to an opening (i.e., the entire surface closer to the axial outlet port 6 when the rotating cylindrical body 100 is disposed in the vacuum pump 1).

Figure 3:
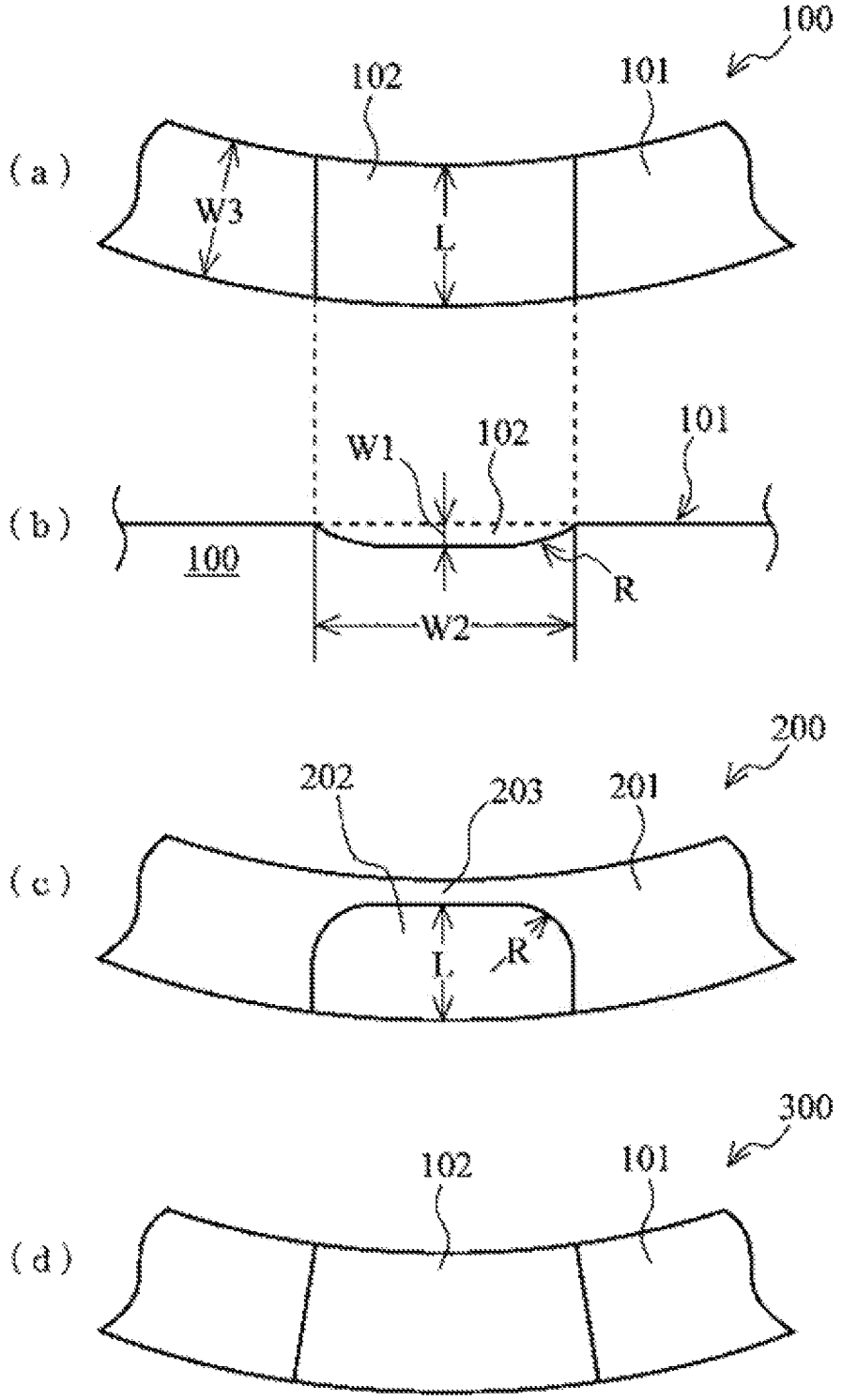
FIG. 3 is a view for illustrating removal portions of the rotating cylindrical bodies according to the embodiment of the present invention and a modification thereof.

Using FIG. 3, a specific description will be given of the removal portion of the present embodiment.

FIGS. 3A and 3B are views for illustrating a removal portion 102 of the rotating cylindrical body 100 according to the present embodiment.

Note that FIG. 3A shows a portion of the cylindrical body lower end portion 101 when the rotating cylindrical body 100 is viewed from the outlet port 6 side of the vacuum pump 1, which is the portion in which the removal portion 102 is formed.

Meanwhile, FIG. 3B shows a portion of the rotating cylindrical body 100 when the rotating cylindrical body 100 is viewed from the casing 2 side (or the shaft 7 side) of the vacuum pump 1, which is the portion in which the removal portion 102 is formed.

As shown in FIGS. 3A and 3B, the rotating cylindrical body 100 of the present embodiment has the removal portion 102 which is formed in at least a portion of the cylindrical body lower end portion 101 by cutting the cylindrical body lower end portion 101.

In the present embodiment, an axial removal width W1 of the removal portion 102 is minimized. Specifically, the removal portion 102 is formed so as to have a shallow recessed shape in the axial direction of the rotating cylindrical body 100. Note that, in other words, the "axial removal width W1" is "a length/depth over which the cylindrical body lower end portion 101 is cut in the axial direction of the rotating cylindrical body 100".

The depth of the removal portion 102 in the axial direction of the rotating cylindrical body 100 can be provided by using a configuration which cuts the cylindrical body lower end portion 102 using, as a cutting tool, an end mill or a router instead of a drill which is used conventionally.

In addition, the processing lines of (shown by) the removal portion 102 in the radial direction of the rotating cylindrical body 100 are preferably parallel with each other.

Additionally, the removal portion 102 is formed by removing the cylindrical body lower end portion 101 such that a circumferential removal width W2 of the removal portion 102 is not less than a thickness (a width W3 in the radial direction) of the cylindrical body lower end portion 101 (i.e., W2≥W3 is satisfied). Note that, in other words, the "circumferential removal width W2" corresponds to a "length over which the cylindrical body lower end portion 101 is cut in the circumferential direction (direction along the arc) of the rotating cylindrical body 100".

For example, when the thickness (W3) of the cylindrical body lower end portion 101 is 10 mm, it is preferable to adjust the circumferential removal width W2 of the removal portion 102 to a value of not less than 10 mm and thus adjust an amount of cutting.

The removal portion 102 of the present embodiment is also formed in an arc shape in at least a portion of the cylindrical body lower end portion 101 having a circular shape.

Moreover, the removal portion 102 is formed by cutting the cylindrical body lower end portion 101 such that a radial removal length L of the removal portion 102 is equal to the thickness (width W3 in the radial direction) of the cylindrical body lower end portion 101 (i.e., L=W3 is satisfied). Note that, in other words, the "radial removal length (L)" is a "length over which the cylindrical body lower end portion 101 is cut in the radial direction of the rotating cylindrical body 100".

Even in a structure (tapered structure) in which the thickness of the rotating cylindrical body 100 gradually decreases with approach to the cylindrical body end portion closer to the opening, the radial removal length L of a bottom portion of the removal portion 102 is preferably set larger than at least a radial dimension of the cylindrical body end portion (i.e., L≥W3 is satisfied).

In the present embodiment, the removal portion 102 is formed by cutting the cylindrical body lower end portion 101 using, as a cutting tool, an end mill or a router, not a drill. This is because, when the cylindrical body lower end portion 101 is cut using, e.g., a drill having a sharply pointed tip (cutting portion), the removal portion 102 may be formed to have a narrow and deep shape and, when the removal portion 102 has a narrow and deep shape, the probability is high that stress concentration occurs.

Also, as shown in FIG. 3B, cutting is performed to allow smoothly angled corners R to be formed in the removal portion 102 after the cutting. In consideration of an amount of removal and a removal width, each of the corners R is preferably formed to have a dimension which is, e.g., approximately larger than R3=3 mm.

As described above, the rotating cylindrical body 100 of the present embodiment has the removal portion 102 formed in at least a portion of the cylindrical body lower end portion 101 by cutting the cylindrical body lower end portion 101 so as to reduce the thickness of the rotating cylindrical body 100 in the axial direction. Due to this configuration, in the present embodiment, it is possible to reduce/lessen stress concentration after imbalance correction based on mass removal.

Also, the removal portion 102 is formed using, as a cutting tool, an end mill or a router. Due to this configuration, it is possible to allow a portion removed to result in the removal portion 102 to occupy a wide and shallow range. Accordingly, it is possible to more efficiently reduce/lessen the stress concentration after the imbalance correction based on mass removal.

Also, the removal portion 102 is provided in the cylindrical body lower end portion 101 of the rotating cylindrical body 100 which is disposed in the portion of the vacuum pump 1 away from the center (such as the shaft 7) thereof. Since the removal portion 102 is thus formed in the portion having a large radius, the imbalance correction can more efficiently be performed.

Next, a description will be given of a modification of the removal portion 102 of the present embodiment.

In the embodiment described above, the configuration is used in which a portion of the arc of the cylindrical body lower end portion 101 is entirely cut in the radial direction to form the removal portion 102, but the configuration is not limited thereto.

FIG. 3C is a view for illustrating a removal portion 202 of a rotating cylindrical body 200 according to the modification of the present embodiment.

Note that, similarly to FIG. 3A descried above, FIG. 3C shows a portion of a cylindrical body lower end portion 201 when the rotating cylindrical body 200 is viewed from the outlet port 6 side of the vacuum pump 1, which is the portion in which the removal portion 202 is formed.

The rotating cylindrical body 200 in the present embodiment has the removal portion 202 formed in at least a portion of the cylindrical body lower end portion 201 by cutting the cylindrical body lower end portion 201.

As shown in FIG. 3C, the removal portion 202 of the present modification has a configuration in which a portion of the are of the cylindrical body lower end portion 201 is not entirely cut, but an unremoved portion 203 is left on the inner side (radially inner side) of the cylindrical body lower end portion 201. Specifically, the cylindrical body lower end portion 201 has a configuration in which, on the radially inner side, the cylindrical body lower end portion 201 is smoothly continued while, on a radially outer side, a portion of the cylindrical body lower end portion 201 is removed to form a recessed portion as the removal portion 202.

Since the configuration in which the unremoved portion 203 in left on the inner side of the cylindrical body lower end portion 201 is used, it is also preferable that each of corners (corresponding to the corner R in FIG. 3B) formed on the unremoved portion 203 side of the removal portion 202 has a dimension of not less than R3=3 mm.

The configuration described above is also applicable to a composite-type vacuum pump including a turbo molecular pump portion and a Siegbahn pump portion.

Figure 4:
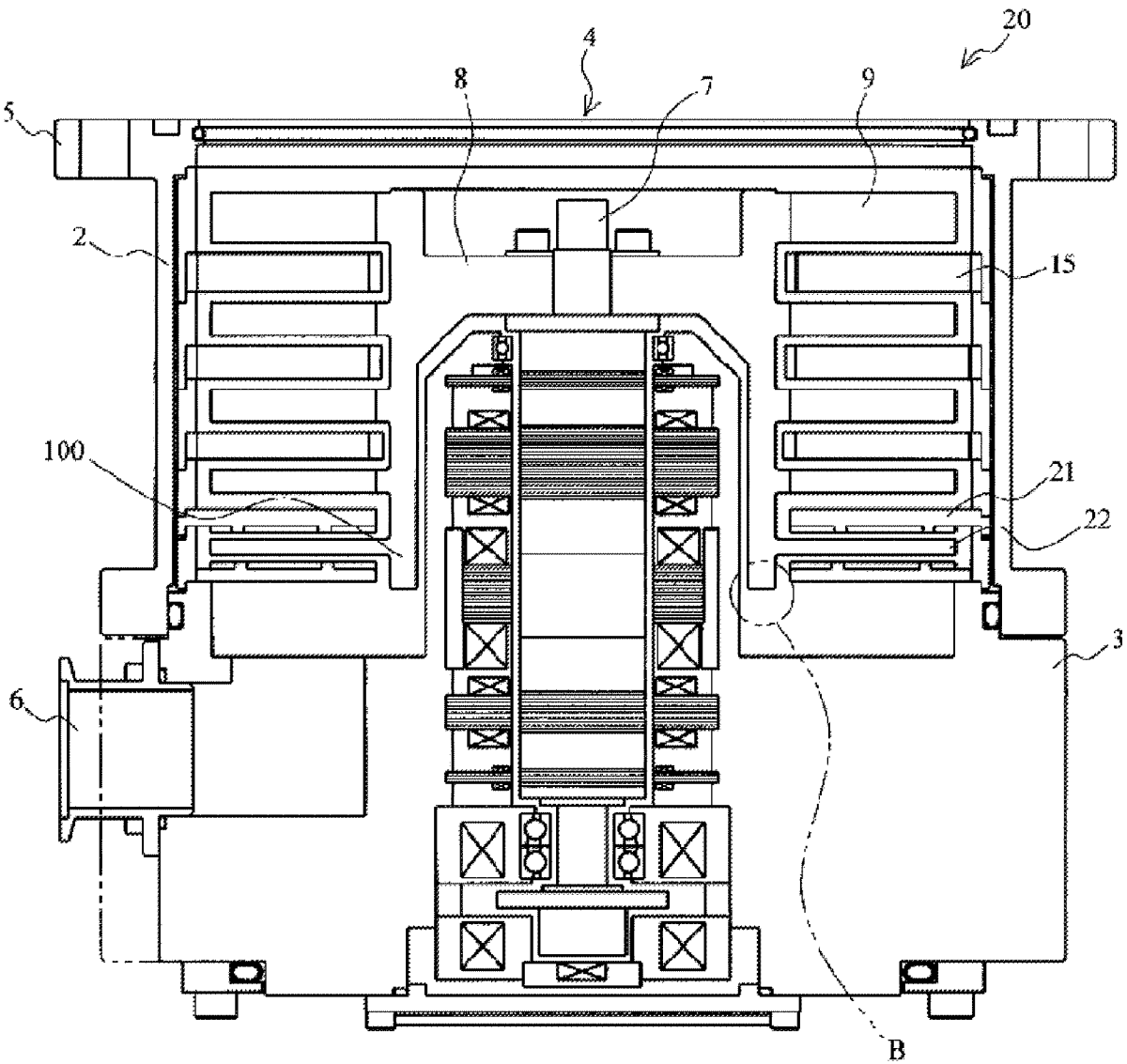
FIG. 4 is a view showing another example of the schematic configuration of the vacuum pump according to the embodiment of the present invention.

FIG. 4 is a view showing another example of the configuration of the vacuum pump 1 of the present embodiment.

Note that the same components as those of the vacuum pump 1 are given the same reference numerals, and a description thereof is omitted.

As shown in FIG. 4, to a composite-type vacuum pump 20 including a turbo molecular pump portion and a Siegbahn pump portion also, the embodiment described above is applicable.

In the case of this configuration example, the vacuum pump 20 has, under the turbo molecular pump portion closer to the inlet port 4, the Siegbahn pump portion having a Siegbahn configuration.

In the Siegbahn pump portion according to the present embodiment, in a surface of a stator disc 21, a helical groove (referred to also as a spiral groove or coil-shaped groove) flow path is engraved.

The stator disc 21 is a disc member which has a radially extending disc shape perpendicular to the axis line of the shaft 7 and in which the spiral groove is engraved. The stator disc 21 is disposed at a single level or a plurality of the stator discs 21 are disposed at multiple levels in the axial direction to alternate with rotor discs 22 (which are not blades) on the inner peripheral side of the casing 2.

In this configuration example, a cylindrical portion below the rotor disc 22 (Siegbahn pump portion) disposed at the lowermost level corresponds to the rotating cylindrical body 100 and, in the portions shown by a two-dot-dash line B, the removal portions (102, 202) are formed.

Note that, in the present embodiment, the configuration in which the spiral groove is formed in the stator disc 21 is used, but the configuration is not limited thereto. The spiral groove may appropriately be formed in either one of the respective opposed surfaces of the stator disc 21 and the rotor disc 22 which are opposed to each other. For example, a configuration in which, e.g., the spiral groove is formed in the surface (surface opposed to the stator disc 21) of the rotor disc 22 may also be used.

The configuration described above is also applicable to an all-wing-type vacuum pump.

Figure 5:
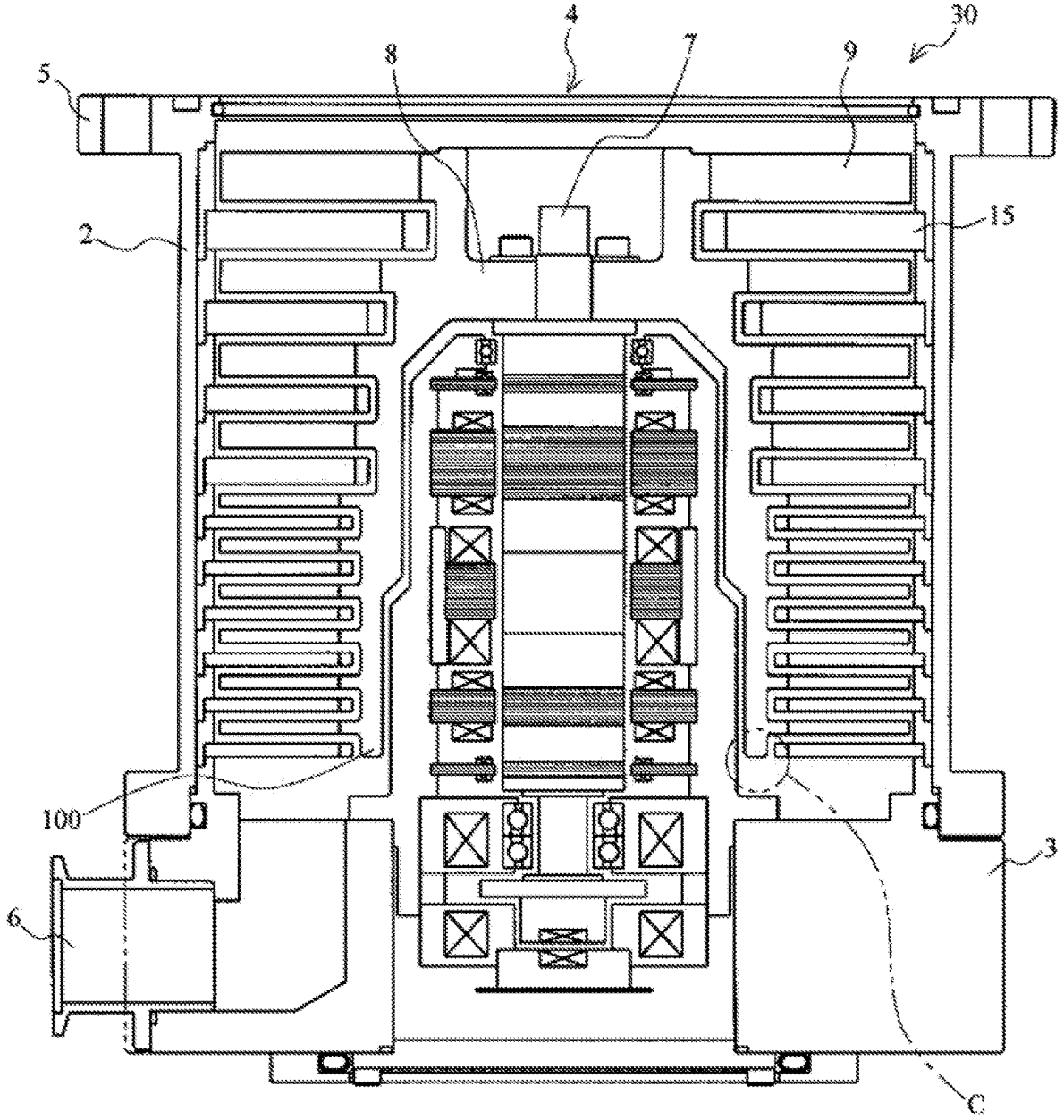
FIG. 5 is a view showing still another example of the schematic configuration of the vacuum pump according to the embodiment of the present invention.
Figure 6:
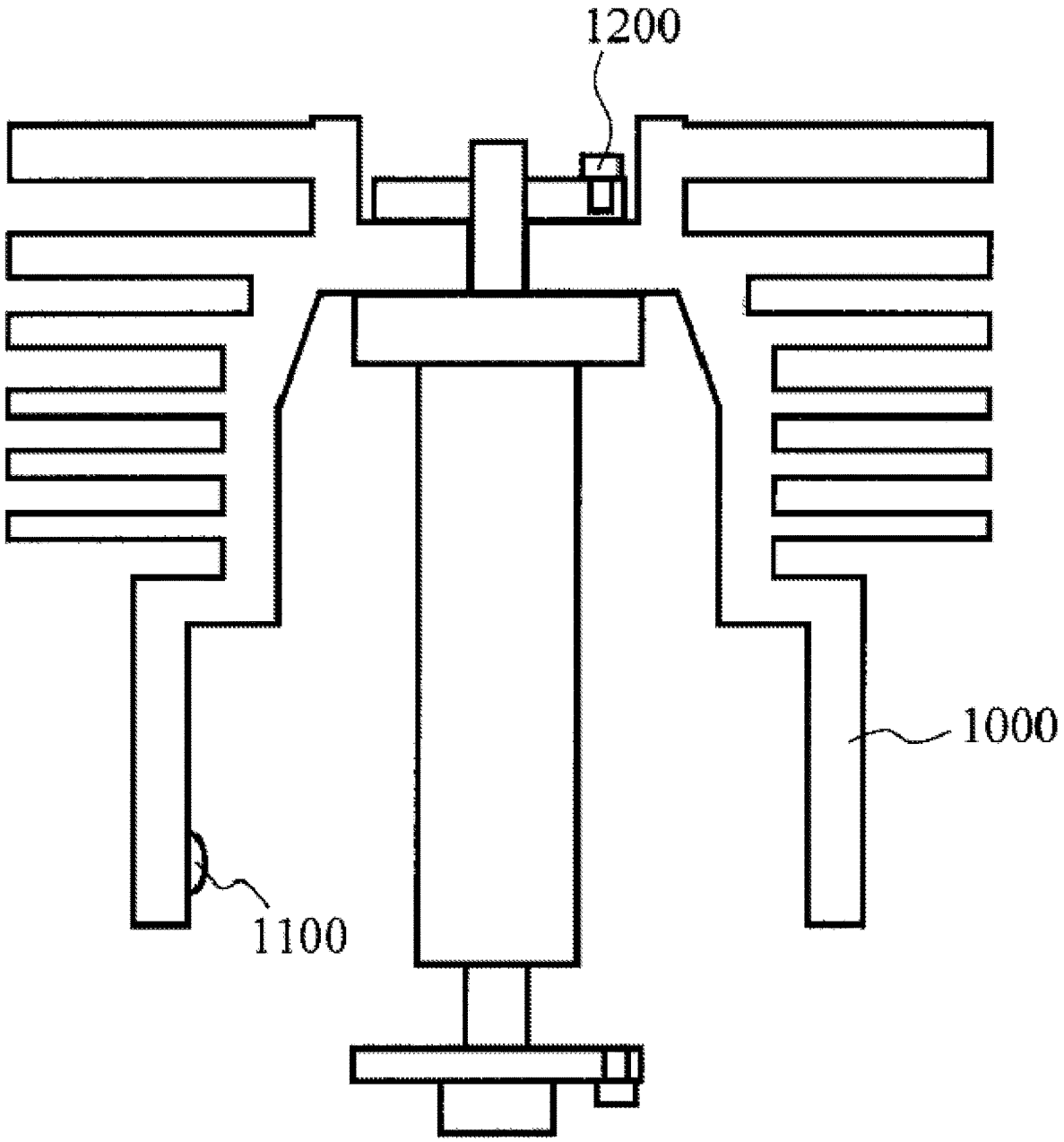
FIG. 6 (PRIOR ART)
FIG. 6 is a view for illustrating imbalance correction based on mass addition according to a related-art technique.
Figure 7:
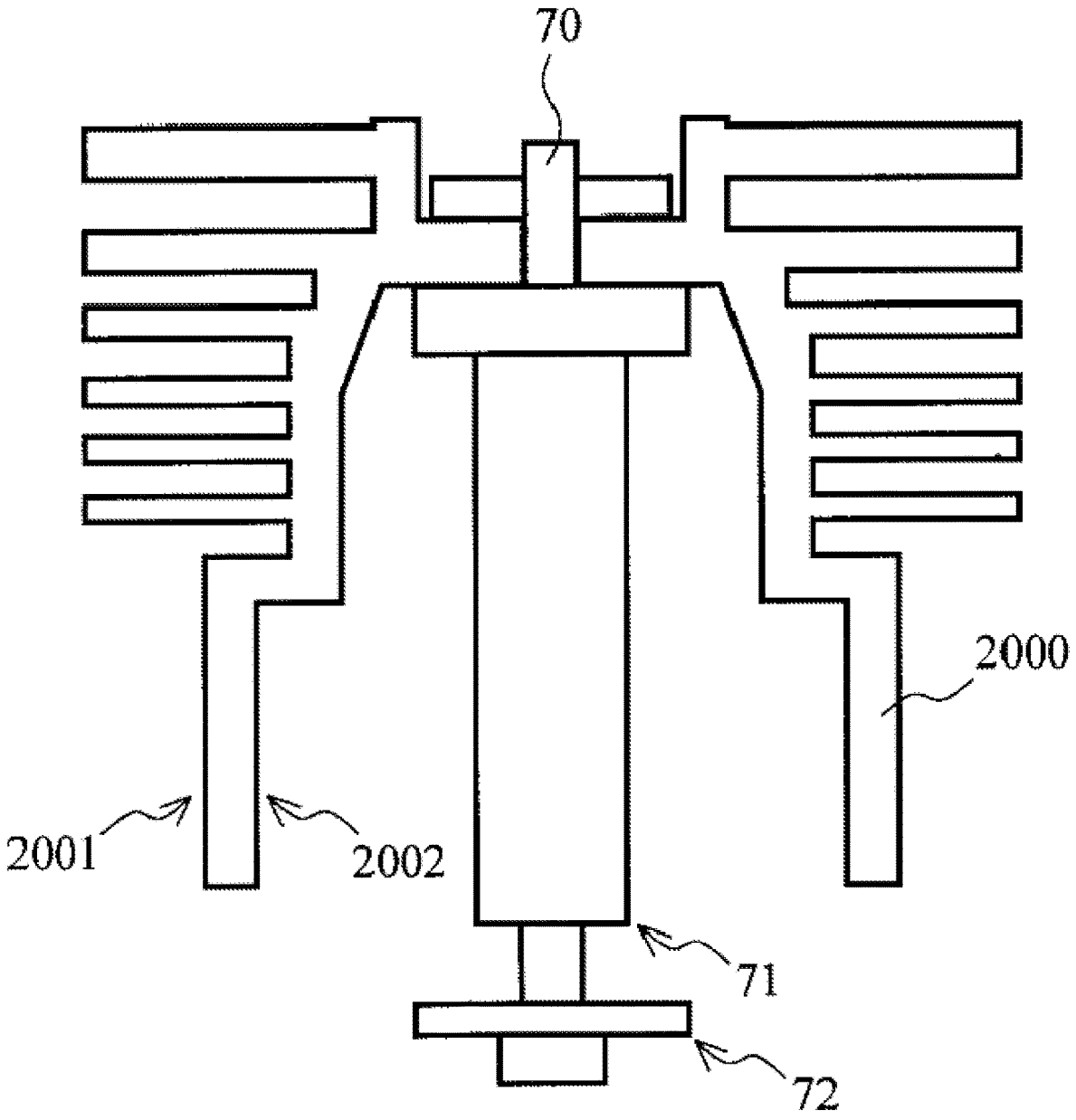
FIG. 7 (PRIOR ART)
FIG. 7 is a view for illustrating imbalance correction based on mass removal according to another related-art technique.

FIG. 5 is a view showing still another example of the configuration of the vacuum pump 1 of the present embodiment.

Note that components equivalent to those of the vacuum pump 1 are given the same reference numerals, and a description thereof is omitted.

As shown in FIG. 5, even to an all-wing-type vacuum pump 30, the embodiment described above is applicable.

Note that, in this configuration example, the cylindrical portion below the rotor blade 9 disposed at the lowermost level corresponds to the rotating cylindrical body 100 and, in the portion shown by a two-dot-dash line C, the removal portions (102 and 202) are formed.

In each of the present embodiments (the vacuum pump 1, the vacuum pump 20, and the vacuum pump 30) described heretofore, for the ease of processing during cutting, the configuration is used in which the removal portion 102 is formed in the cylindrical body lower end portion 101 as an axially lower surface (lower end portion closer to the outlet port 6) of the rotating cylindrical body 100. However, the configuration is not limited thereto.

For example, a configuration in which the removal portion 102 is formed in an axially upper surface (upper end portion closer to the inlet port 4) of the rotating cylindrical body 100 may also be used. More specifically, the configuration is such that the cylindrical portion of the rotor 8 located above the position where the uppermost-level rotor blade 9 (closer to the inlet port 4) is disposed is assumed to serve as the rotating cylindrical body 100 and, in at least a portion of the upper end (surface opposed to the inlet port 4) of the rotating cylindrical body 100, the removal portion 102 is formed.

Alternatively, a configuration in which both of the upper end (upper surface) and the lower end (lower surface) of the rotating cylindrical body 100 in the axial direction are cut, and imbalance correction is performed using the two surfaces may also be used.

This configuration is also applicable to the removal portion 202 formed in the rotating cylindrical body 200 of the modification described above.

In each of the present embodiments, as shown in FIG. 3A, the configuration is used in which the processing lines of (or defined by) the removal portion 102 in the radial direction of the rotating cylindrical body 100 are parallel with each other. However, the configuration is not limited thereto.

For example, as shown in FIG. 3D, a configuration in which the radial processing lines of the removal portion 102 are parallel with imaginary lines (lines each drawn from the center to show a radius) in the radial direction of the rotating cylindrical body (rotating cylindrical body 300) may also be used.

Note that this configuration is also applicable to the removal portion 202 formed in the rotating cylindrical body 200 of the modification described above.

Each of the present embodiments and modification is applicable to either of the cases where anti-corrosion coating (such as nickel alloy plating) is performed on the rotating cylindrical body 100 and the removal portion 102 and where such anti-corrosion coating is not performed thereon.

Note that each of the embodiments and modification of the present invention may also be configured to be combined with each other as necessary.

Various modifications can be made to the present invention without departing from the spirit of the present invention. It should be clearly understood that the present invention is intended to encompass such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a rotating portion that is enclosed in a housing having an inlet port and an outlet port each formed therein and is rotatably supported, the vacuum pump rotating the rotating portion at a high speed to transfer gas sucked in from the inlet port to the outlet port, wherein an imbalance correction portion is formed at a cylindrical body end portion of the rotating portion in an axial direction thereof, the imbalance correction portion being formed by removing a predetermined portion of a lower surface of the cylindrical body end portion in a circumferential direction and the imbalance correction portion has a recessed shape formed in the axial direction and has circumferential end portions formed in the circumferential direction.

2. The vacuum pump according to claim 1, wherein the imbalance correction portion is in a shape of a groove having a depth in the axial direction.

3. The vacuum pump according to claim 1, wherein the imbalance correction portion is formed in the cylindrical body end portion of the rotating portion closer to an opening thereof.

4. The vacuum pump according to claim 3, wherein the imbalance correction portion has a width in the circumferential direction thereof which has a dimension of not less than a thickness of the cylindrical body end portion in a radial direction thereof.

5. The vacuum pump according to claim 3, wherein the imbalance correction portion has a dimension in a radial direction thereof which is not less than a thickness of the cylindrical body end portion in the radial direction.

6. The vacuum pump according to claim 1, wherein the imbalance correction portion has a corner portion which is formed at a bottom surface of the imbalance correction portion in the axial direction or formed in the radial direction of the imbalance correction portion so as to have a radius of 3 mm or more.

7. The vacuum pump according to claim 1, further comprising:

a rotor blade disposed on an outer peripheral surface of at least a portion of the rotating portion so as to radially extend from the outer peripheral surface;

a stator blade opposed to the rotor blade via a gap in the axial direction; and a turbo molecular pump which transfers the gas sucked in from the inlet port to the outlet port using an interaction between the rotor blade and the stator blade.

8. The vacuum pump according to claim 1, further comprising:

a stationary cylindrical portion disposed coaxially to the rotating portion to be opposed to the rotating portion via a gap in the radial direction, wherein, in at least a portion of at least one of respective surfaces, the surface being opposed to each other in the radial direction, of the rotating portion and the stationary cylindrical portion, a spiral groove having a valley portion and a ridge portion is disposed, the vacuum pump further comprising:

a Holweck thread groove pump portion which transfers the gas sucked in from the inlet port to the outlet port using an interaction between the rotating portion and the stationary cylindrical portion.

9. The vacuum pump according to claim 1, further comprising:

a rotating disc-shaped portion disposed to radially extend from an outer peripheral surface of at least a portion of the rotating portion; and a stationary disc-shaped portion disposed coaxially to the rotating disc-shaped portion to be opposed to the rotating disc-shaped portion via a gap in the axial direction, wherein, in at least a portion of at least one of respective surfaces of the rotating disc-shaped portion and the stationary disc-shaped portion which are opposed to each other in the axial direction, a spiral groove having a valley portion and a ridge portion is disposed, the vacuum pump further comprising:

a Siegbahn thread groove pump portion which transfers the gas sucked in from the inlet port to the outlet port using an interaction between the rotating disc-shaped portion and the stationary disc-shaped portion.

10. A rotating portion included in a vacuum pump, comprising:

a housing enclosing and rotatably supporting the rotating portion and having an inlet port and an outlet port each formed therein, the vacuum pump rotating the rotating portion at a high speed to transfer gas sucked in from the inlet port to the outlet port, wherein an imbalance correction portion is formed at a cylindrical body end portion of the rotating portion in an axial direction thereof, the imbalance correction portion being formed by removing a predetermined portion of a lower surface of the cylindrical body end portion in a circumferential direction and the imbalance correction portion has a recessed shape formed in the axial direction and has circumferential end portions formed in the circumferential direction.

11. An imbalance correction method comprising:

in a vacuum pump comprising:

a rotating portion that is enclosed in a housing having an inlet port and an outlet port each formed therein and is rotatably supported, the vacuum pump rotating the rotating portion at a high speed to transfer gas sucked in from the inlet port to the outlet port;

forming an imbalance correction portion at a cylindrical body end portion of the rotating portion in the axial direction in order to correct an imbalance of the rotating portion, and forming the imbalance correction portion by removing a predetermined portion of a lower surface of the cylindrical body end portion in a circumferential direction, so that the imbalance correction portion has a recessed shape formed in the axial direction and has circumferential end portions formed in the circumferential direction.

* * * * *